US010712004B2

(12) United States Patent
Kugimiya et al.

(10) Patent No.: US 10,712,004 B2
(45) Date of Patent: Jul. 14, 2020

(54) COMBUSTOR INCLUDING AN ACOUSTIC DEVICE MOUNTED ON A COMBUSTION LINER FOR DAMPING COMBUSTION OSCILLATION OF A PREDETERMINED FREQUENCY AND GAS TURBINE

(71) Applicant: MITSUBISHI HITACHI POWER SYSTEMS, LTD., Yokohama-shi, Kanagawa (JP)

(72) Inventors: Wataru Kugimiya, Tokyo (JP); Taiki Kinoshita, Kanagawa (JP); Atsushi Koyama, Kanagawa (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 185 days.

(21) Appl. No.: 15/736,064

(22) PCT Filed: Jul. 6, 2016

(86) PCT No.: PCT/JP2016/070051
§ 371 (c)(1),
(2) Date: Dec. 13, 2017

(87) PCT Pub. No.: WO2017/006971
PCT Pub. Date: Jan. 12, 2017

(65) Prior Publication Data

US 2018/0180288 A1 Jun. 28, 2018

(30) Foreign Application Priority Data

Jul. 8, 2015 (JP) ..... 2015-137077

(51) Int. Cl.
*F23R 3/00* (2006.01)
*F23R 3/46* (2006.01)
(Continued)

(52) U.S. Cl.
CPC ..... *F23R 3/002* (2013.01); *F23R 3/28* (2013.01); *F23R 3/42* (2013.01); *F23R 3/46* (2013.01);
(Continued)

(58) Field of Classification Search
CPC .... F23R 3/002; F23R 3/28; F23R 3/42; F23R 2900/00014; G10K 11/16; G10K 11/162
See application file for complete search history.

(56) References Cited

U.S. PATENT DOCUMENTS

2005/0034918 A1 2/2005 Bland et al.
2010/0186411 A1 7/2010 Matsuyama et al.
(Continued)

FOREIGN PATENT DOCUMENTS

CN 104033926 9/2014
CN 104204676 12/2014
(Continued)

OTHER PUBLICATIONS

Office Action dated Mar. 13, 2019 in corresponding Chinese Patent Application No. 201680015810.1 with Machine translation.
(Continued)

*Primary Examiner* — Steven M Sutherland
(74) *Attorney, Agent, or Firm* — Wenderoth, Lind & Ponack, L.L.P.

(57) ABSTRACT

A combustor includes: a combustion liner having a first region in which at least one first opening is formed; a nozzle configured to inject a fuel into the combustion liner; and a first acoustic device mounted to the combustion liner. The first acoustic device includes: a first casing portion having at least one first wall disposed facing the first region on an outer side of the combustion liner and at least one second opening formed thereon. The first casing portion defining at least one first space in communication with an inside of the
(Continued)

combustion liner through the first opening; and a second casing portion having at least one second wall disposed facing the first wall on an outer side of the first casing portion. The second casing portion defines, between the first wall and the second wall, a second space in communication with the first space through the second opening.

12 Claims, 10 Drawing Sheets

(51) Int. Cl.
*F23R 3/28* (2006.01)
*F23R 3/42* (2006.01)
*G10K 11/162* (2006.01)

(52) U.S. Cl.
CPC .. *G10K 11/162* (2013.01); *F23R 2900/00014* (2013.01)

(56) References Cited

U.S. PATENT DOCUMENTS

2011/0138812 A1* 6/2011 Johnson ..... F23R 3/00 60/725
2011/0179795 A1* 7/2011 Johnson ..... F23R 3/28 60/725
2011/0220433 A1 9/2011 Nakamura et al.
2011/0265484 A1* 11/2011 Huber ..... F23R 3/002 60/755
2013/0206500 A1 8/2013 Ono et al.
2014/0238029 A1* 8/2014 Sutcu ..... F23R 3/10 60/754
2015/0020498 A1 1/2015 Schilp
2015/0059345 A1 3/2015 Hellat et al.

FOREIGN PATENT DOCUMENTS

EP 1 400 662 3/2004
EP 2642204 A1 * 9/2013 ..... F23R 3/00
JP 2008-121961 5/2008
JP 2009-97841 5/2009
JP 2013-117231 6/2013
JP 2015-518534 7/2015
KR 10-2011-0046543 5/2011
WO 2012/127959 9/2012

OTHER PUBLICATIONS

Notification of Reason for Refusal dated Mar. 20, 2019 in corresponding Korean Patent Application No. 10-2017-7036177, with Machine Translation.
Japanese Office Action dated May 9, 2019 in corresponding Japanese Patent Application No. 2015-137077 with Machine Translation.
International Search Report dated Oct. 4, 2016 in International Application No. PCT/JP2016/070051.
International Preliminary Report on Patentability dated Jan. 18, 2018 in International Application No. PCT/JP2016/070051.
Office Action dated May 13, 2020 in counterpart DE application No. 112016002108.9 with Machine Translation.

* cited by examiner

COMBUSTOR INCLUDING AN ACOUSTIC DEVICE MOUNTED ON A COMBUSTION LINER FOR DAMPING COMBUSTION OSCILLATION OF A PREDETERMINED FREQUENCY AND GAS TURBINE

TECHNICAL FIELD

The present disclosure relates to a combustor and a gas turbine.

BACKGROUND ART

A gas turbine is provided with a combustor and a turbine which utilizes combustion gas produced through combustion of fuel by the combustor to generate a rotational force. The combustor includes an acoustic device called an acoustic liner (combustion oscillation reduction device) mounted thereto. An acoustic liner is capable of damping combustion oscillation of a predetermined frequency generated by combination of an acoustic mode and a combustion system.

For instance, Patent Document 1 discloses an acoustic liner which defines a gas space in communication with the inside of the transition piece of the combustor via a vent hole and which is capable of damping combustion oscillation of a predetermined frequency.

CITATION LIST

Patent Literature

Patent Document 1: JP2009-97841A

SUMMARY

Problems to be Solved

Typically, an acoustic liner is designed to have a single tuning frequency, and is capable of damping combustion oscillation of the tuning frequency or a frequency around the tuning frequency.

However, in the combustion oscillation, a plurality of modes (combustion modes) with considerably different frequencies may occur due to various causes such as the combustion state. While it is desirable to be able to damp a greater number of combustion oscillation modes during operation of a gas turbine, combustion oscillation modes having a frequency considerably different from the tuning frequency cannot be damped with a single acoustic liner.

Thus, to damp a plurality of combustion oscillation modes having considerably different frequencies, it is necessary to provide a plurality of acoustic liners. However, the number of installable acoustic liners is limited due to the installation space and costs. That is, while it is desirable to damp a greater number of combustion oscillation modes, in reality, the number of combustion oscillation modes that can be damped is limited depending on the number of acoustic liners that can be provided.

In view of the above, an object of at least one embodiment of the present invention is to provide a combustor and a gas turbine provided with an acoustic device capable of damping a plurality of combustion oscillation modes.

Solution to the Problems (1) A combustor according to at least one embodiment of the present invention comprises: a combustion liner having a first region in which at least one first opening is formed; a nozzle configured to inject a fuel into the combustion liner; and a first acoustic device mounted to the combustion liner. The first acoustic device includes: a first casing portion having at least one first wall which is disposed facing the first region on an outer side of the combustion liner and which has at least one second opening formed thereon, the first casing portion defining, between the first region and the at least one first wall, at least one first space being in communication with an inside of the combustion liner through the at least one first opening; and a second casing portion having at least one second wall which is disposed facing the at least one first wall on an outer side of the first casing portion, the second casing portion defining, between the at least one first wall and the at least one second wall, at least one second space being in communication with the at least one first space through the at least one second opening.

In the combustor having the above configuration (1), the second space exists outside the first space and is in communication with the first space through the first opening, and thereby the first acoustic device has a plurality of tuning frequencies. Thus, it is possible to damp a plurality of combustion oscillation modes having different frequencies with the first acoustic device.

(2) In some embodiments, in the above configuration (1), the at least one first opening and the at least one second opening are disposed on the same position or on different positions in an axial direction of the combustion liner.

(3) In some embodiments, in the above configuration (1) or (2), the at least one second space includes a plurality of second spaces separated from one another by a partition wall and having different heights in a radial direction of the combustion liner.

In the combustor having the above configuration (3), the plurality of second spaces separated by the partition wall have different heights, and thereby the first acoustic device can have more tuning frequencies. Thus, it is possible to damp more combustion oscillation modes with the first acoustic device.

(4) In some embodiments, in the above configuration (3), the plurality of second spaces are arranged along a circumferential direction of the combustion liner.

In the combustor having the above configuration (4), the plurality of second spaces are arranged along the circumferential direction of the combustion liner, and thus it is possible to provide the plurality of second spaces having different heights with a simple configuration.

(5) In some embodiments, in the above configuration (3) or (4), the plurality of second spaces are arranged along an axial direction of the combustion liner.

In the combustor having the above configuration (5), the plurality of second spaces are arranged along the axial direction of the combustion liner, and thus it is possible to provide the plurality of second spaces having different heights with a simple configuration.

(6) In some embodiments, in the above configuration (5), the heights of the plurality of second spaces decrease in stages toward the nozzle in the axial direction of the combustion liner.

In the vicinity of flame, that is, in the vicinity of the nozzle, a combustion oscillation mode with a higher frequency tends to occur, compared to in a region farther from the flame. Corresponding to this tendency, in the combustor having the above configuration (6), the heights of the second spaces decrease in stages toward the nozzle in the axial direction of the combustion liner, and thereby it is possible to damp the combustion oscillation mode of a high frequency in the vicinity of the flame.

(7) In some embodiments, in any one of the above configurations (1) to (6), the first acoustic device is disposed within a range corresponding to an inner diameter of the combustion liner from a tip of the nozzle, in an axial direction of the combustion liner.

Within the range corresponding to the inner diameter of the combustion liner from the tip of the nozzle, a larger number of combustion oscillation modes tends to occur than outside the range. Corresponding to this tendency, with the combustor having the above configuration (7), the first acoustic device is disposed within the range corresponding to the inner diameter of the combustion liner in the axial direction of the combustion liner, and thereby it is possible to damp a large number of combustion oscillation modes effectively.

(8) In some embodiments, in any one of the above configurations (1) to (7), the combustor further comprises a second acoustic device mounted to the combustor. The combustion liner further includes a second region in which at least one third opening is formed. The second acoustic device includes a third wall disposed facing the second region on an outer side of the combustion liner, the second acoustic device defining, between the second region and the third wall, at least one third space being in communication with the inside of the combustion liner through the at least one third opening.

With the combustor having the above configuration (8), it is possible to damp even more combustion oscillation modes by providing the second acoustic device in addition to the first acoustic device.

(9) In some embodiments, in the above configuration (8), a sum of a height of the first space and a height of the second space in a radial direction of the combustion liner is greater than a height of the third space, and the height of the first space is smaller than the height of the third space.

In the combustor having the above configuration (9), the first acoustic device has a tuning frequency corresponding to the height of the first space, and a tuning frequency corresponding to the sum of the height of the first space and the height of the second space. The second acoustic device has a tuning frequency corresponding to the height of the third space, and the tuning frequency of the second acoustic device is in between the two frequencies of the first acoustic device. Thus, it is possible to damp combustion oscillation modes continuously over a wide frequency range.

(10) In some embodiments, in the above configuration (8) or (9), the first acoustic device is disposed closer to the nozzle than the second acoustic device in the axial direction of the combustion liner.

The closer to the nozzle, a larger number of combustion oscillation modes tends to occur. Corresponding to this tendency, in the combustor having the above configuration (10), the first acoustic device is disposed closer to the nozzle than the second acoustic device in the axial direction of the combustion liner, and thereby it is possible to damp a large number of combustion oscillation modes effectively.

(11) A gas turbine according to at least one embodiment of the present invention comprises: the combustor according to any one of the above (1) to (10); and a turbine configured to generate a rotational force from combustion gas produced through combustion of the fuel by the combustor.

In the gas turbine having the above configuration (11), the second space exists outside the first space and is in communication with the first space through the first opening, and thereby the first acoustic device has a plurality of tuning frequencies. Thus, it is possible to damp a plurality of combustion oscillation modes having different frequencies with the first acoustic device.

Advantageous Effects

According to at least one embodiment of the present invention, it is possible to provide a combustor and a gas turbine provided with an acoustic device capable of damping a plurality of combustion oscillation modes.

DETAILED DESCRIPTION

Embodiments of the present invention will now be described in detail with reference to the accompanying drawings. It is intended, however, that unless particularly specified, dimensions, materials, shapes, relative positions and the like of components described in the embodiments shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

Figure 1:
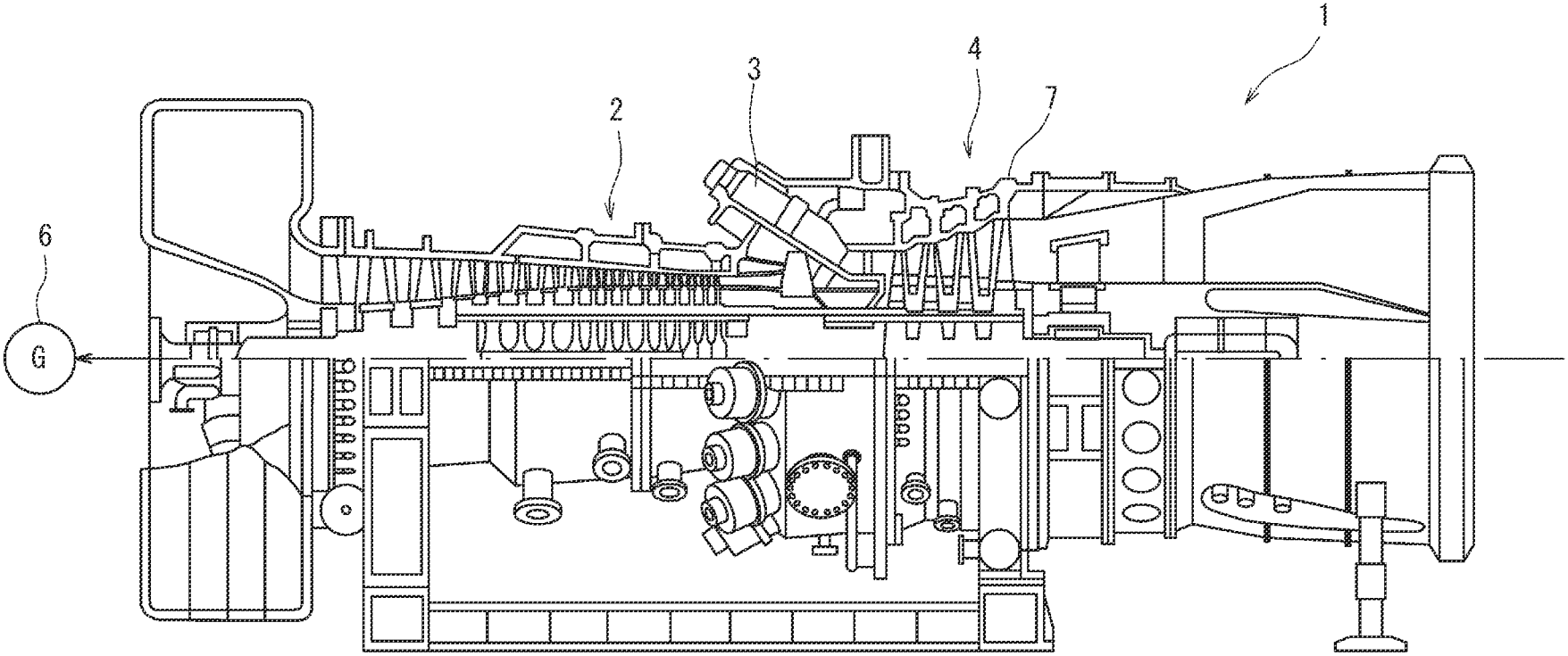
FIG. 1 is a schematic configuration diagram of a gas turbine according to an embodiment of the present invention.

FIG. 1 is a schematic configuration diagram of a gas turbine 1 according to an embodiment of the present invention. As shown in FIG. 1, the gas turbine 1 according to the present embodiment includes a compressor (compressing part) 2, a combustor (combustion part) 3, and a turbine (turbine part) 4, and for instance, drives an external device such as a generator 6.

The compressor 2 sucks in and compresses atmosphere, which is external air, and supplies the compressed air to at least one combustor 3.

The combustor 3 combusts fuel supplied from outside by using air compressed by the compressor 2, thereby producing high-temperature gas (combustion gas).

The turbine 4 generates a rotational driving force in response to supply of high-temperature gas produced by the combustor 3, and outputs the generated rotational driving force to the compressor 2 and an external device.

Figure 2:
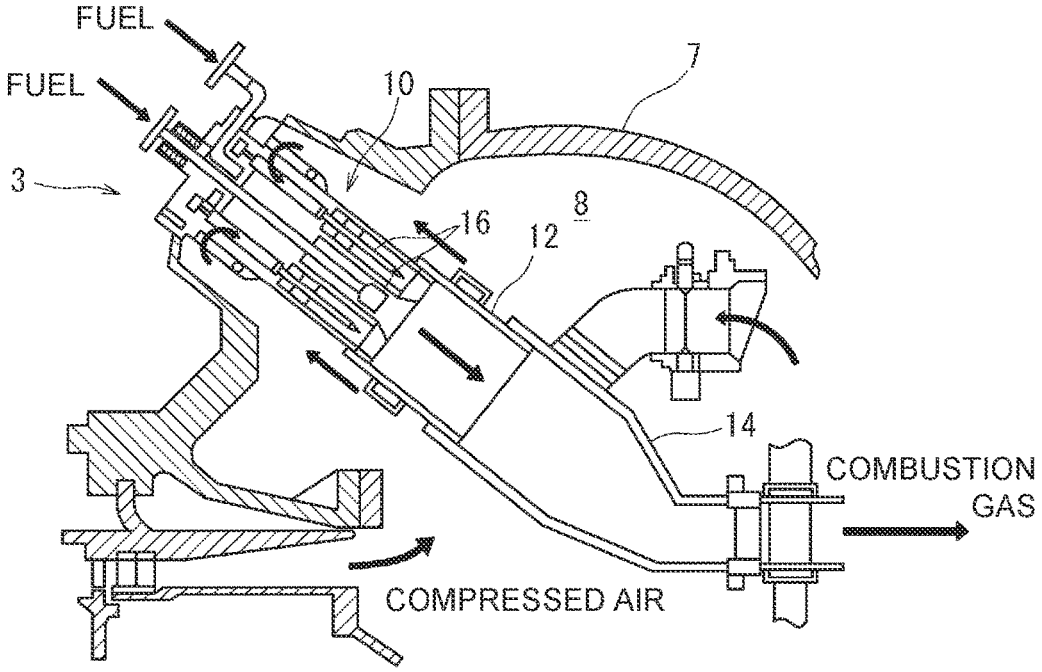
FIG. 2 is a diagram for describing a peripheral configuration of a combustor of a gas turbine.

FIG. 2 is a diagram for describing a peripheral configuration of the combustor 3 of the gas turbine 1. As shown in FIG. 2, a combustor installation space 8 is disposed inside the housing 7 of the gas turbine 1, and the combustor installation space 8 is positioned between an outlet of the compressor 2 and an inlet of the turbine 4. The combustor 3 is disposed in the combustor installation space 8, and the compressed air flows into the combustor 3 from one end side of the combustor 3. The combustor 3 is supplied with fuel from outside.

More specifically, the combustor 3 includes a nozzle portion 10, a combustion liner 12, and a transition piece 14. The nozzle portion 10 has at least one nozzle 16 which injects fuel supplied from outside into the combustion liner 12. For instance, the nozzle 16 includes one pilot nozzle 16*a*, and a plurality of main nozzles 16*b* disposed concentrically around the pilot nozzle 16*a*.

The combustion liner 12 has a tube shape, and has a cylindrical shape, for instance. The nozzle portion 10 is joined to one end side (upstream end side) of the combustion liner 12, and an interior space (combustion space) 18 is defined inside the combustion liner 12, where fuel injected from the nozzle 16 is combusted. The interior space 18 is supplied with compressed air via gaps between the nozzles 16, and thereby the fuel reacts with the compressed air to be combusted, thus generating combustion gas.

The transition piece 14 has a tube shape and is joined to the other end side (downstream end side) of the combustion liner 12. The cross-sectional shape of the transition piece 14 gradually changes in the axial direction of the combustor 3, that is, the flow direction of the combustion gas. The transition piece 14 connects the combustion liner 12 to the inlet of the turbine 4. For instance, each of the combustion liner 12 and the transition piece 14 is formed by a plate having a plurality of cooling flow passages formed therein.

The gas turbine 1 includes the first acoustic device (first acoustic liner) 20 mounted to the combustor 3.

Figure 3:
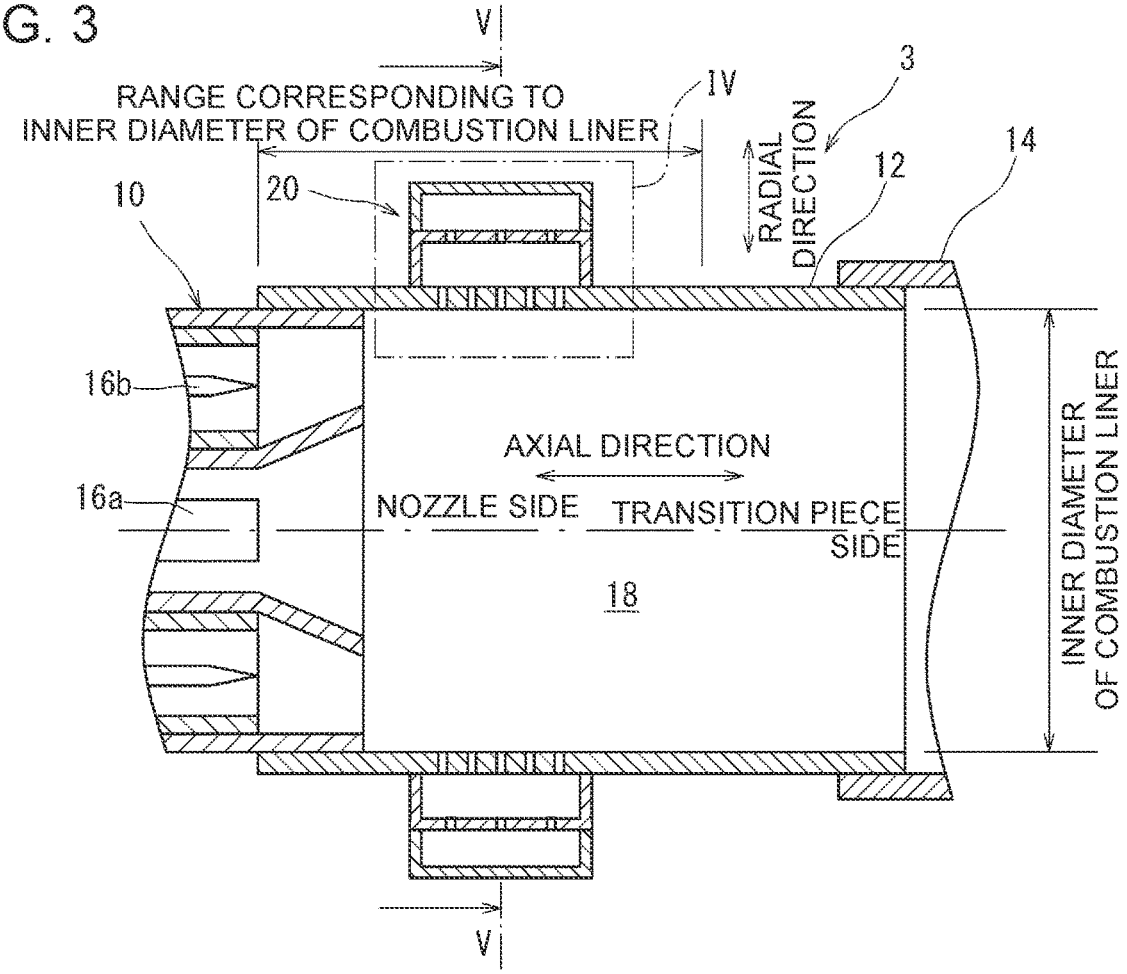
FIG. 3 is a vertical cross-sectional view schematically showing a first acoustic device according to an embodiment of the present invention, along with a combustion liner of a combustor and its peripheral structure.
Figure 4:
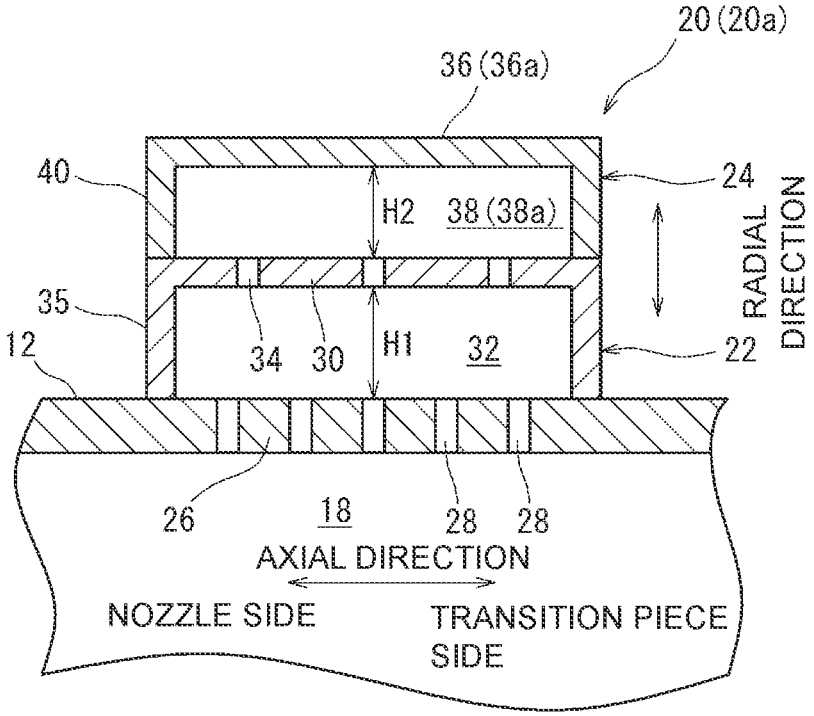
FIG. 4 is an enlarged partial cross-sectional view of region IV in FIG. 3.
Figure 5:
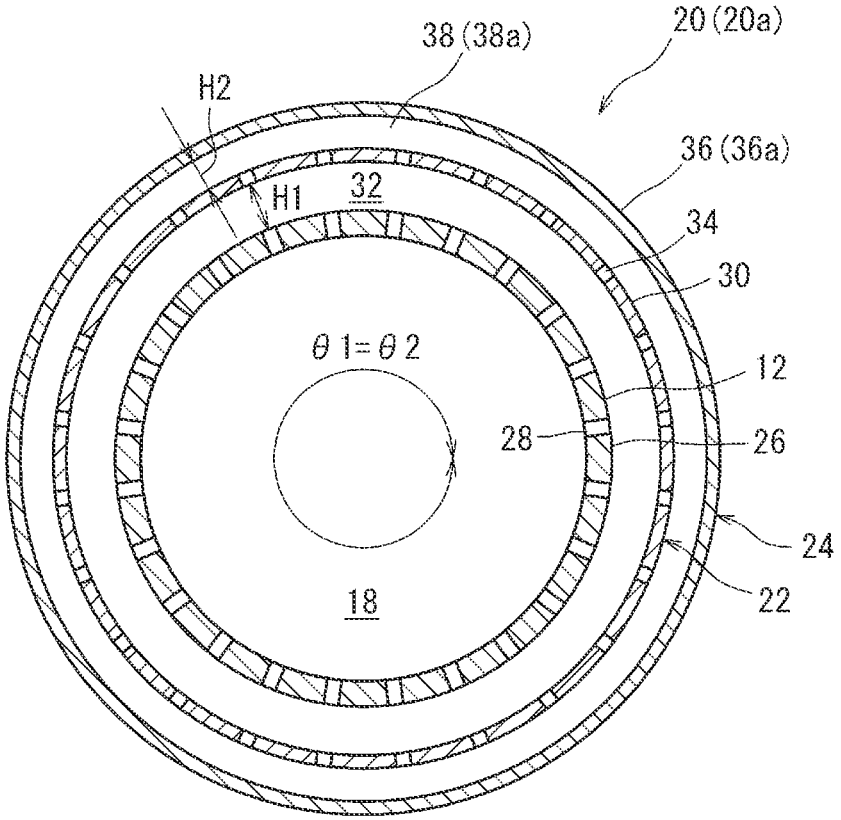
FIG. 5 is a schematic lateral cross-sectional view taken along line V-V in FIG. 3.
Figure 6:
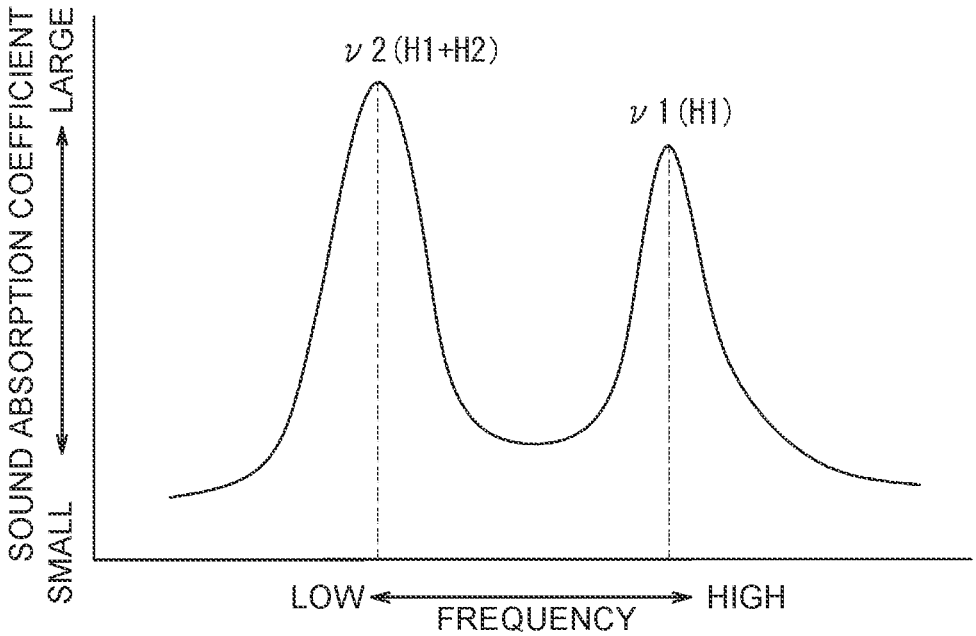
FIG. 6 is a schematic graph showing the sound absorption property of the first acoustic device shown in FIGS. 3 to 5.

FIG. 3 is a vertical cross-sectional view schematically showing the first acoustic device 20*a* according to an embodiment of the present invention, along with the combustion liner 12 of the combustor 3 and its peripheral structure. FIG. 4 is an enlarged partial cross-sectional view of region IV in FIG. 3. FIG. 5 is a schematic lateral cross-sectional view taken along line V-V in FIG. 3. FIG. 6 is a schematic graph showing the sound absorption property of the first acoustic device 20*a*.

Figure 7:
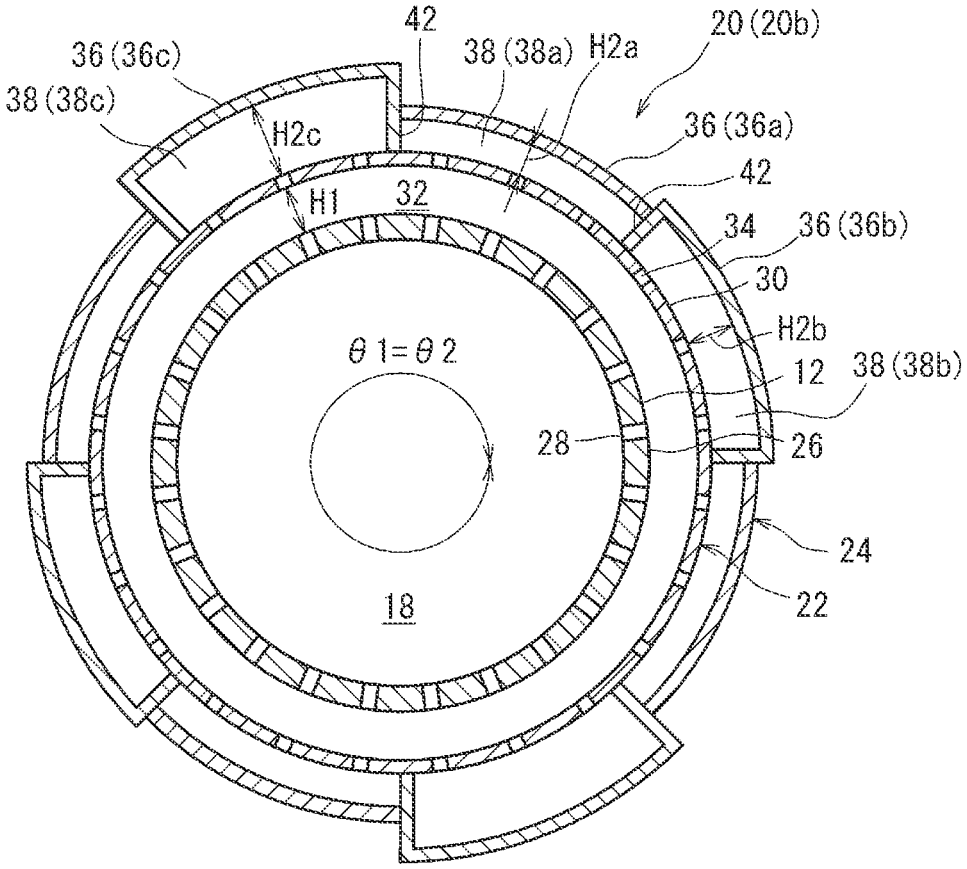
FIG. 7 is a lateral cross-sectional view corresponding to FIG. 5, schematically showing the first acoustic device according to another embodiment of the present invention.
Figure 8:
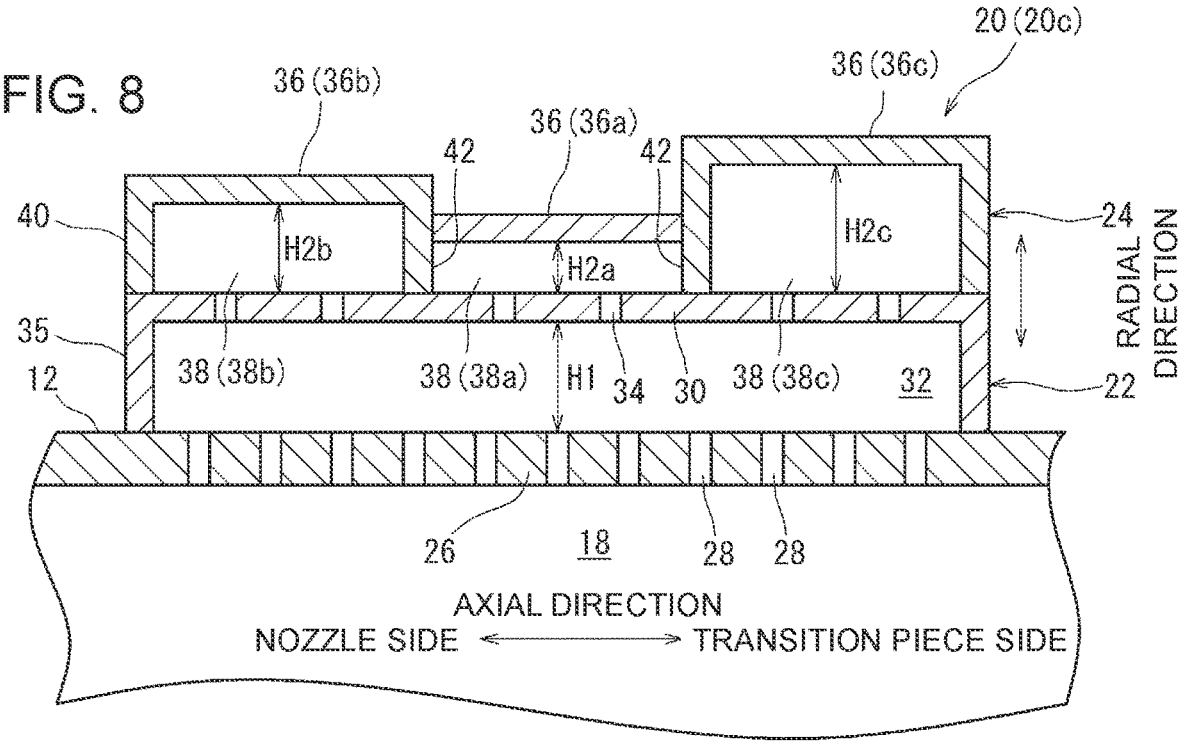
FIG. 8 is a vertical cross-sectional view corresponding to FIG. 4, schematically showing the first acoustic device according to another embodiment of the present invention.
Figure 9:
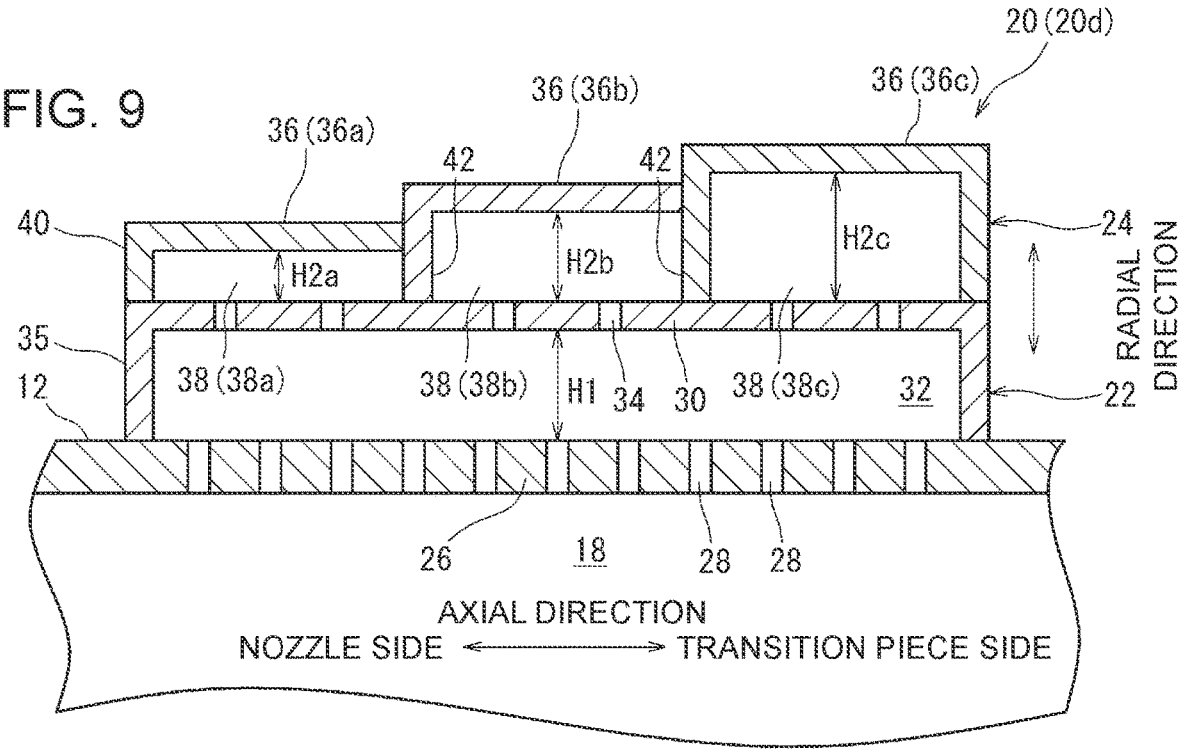
FIG. 9 is a vertical cross-sectional view corresponding to FIG. 4, schematically showing the first acoustic device according to another embodiment of the present invention.
Figure 10:
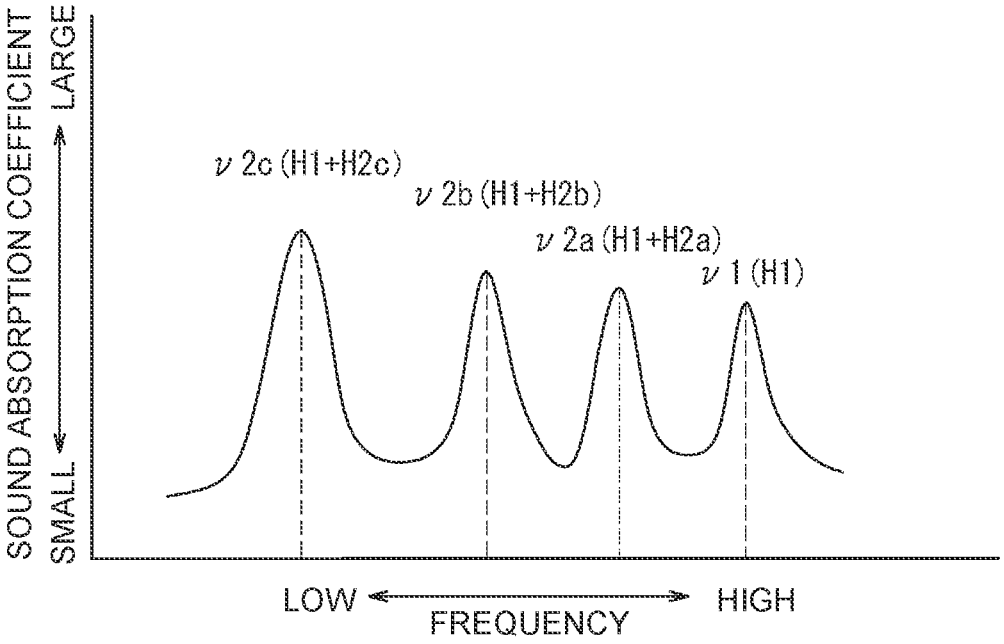
FIG. 10 is a schematic graph showing the sound absorption property of the first acoustic device shown in FIGS. 7 to 9.

FIG. 7 is a lateral cross-sectional view corresponding to FIG. 5, schematically showing the first acoustic device 20*b* according to another embodiment of the present invention. FIGS. 8 and 9 are each a vertical cross-sectional view corresponding to FIG. 4, schematically showing the first acoustic device 20*c*, 20*d* according to another embodiment of the present invention. FIG. 10 is a schematic graph showing the sound absorption property of the first acoustic device 20*b*, 20*c*, 20*d*.

Figure 11:
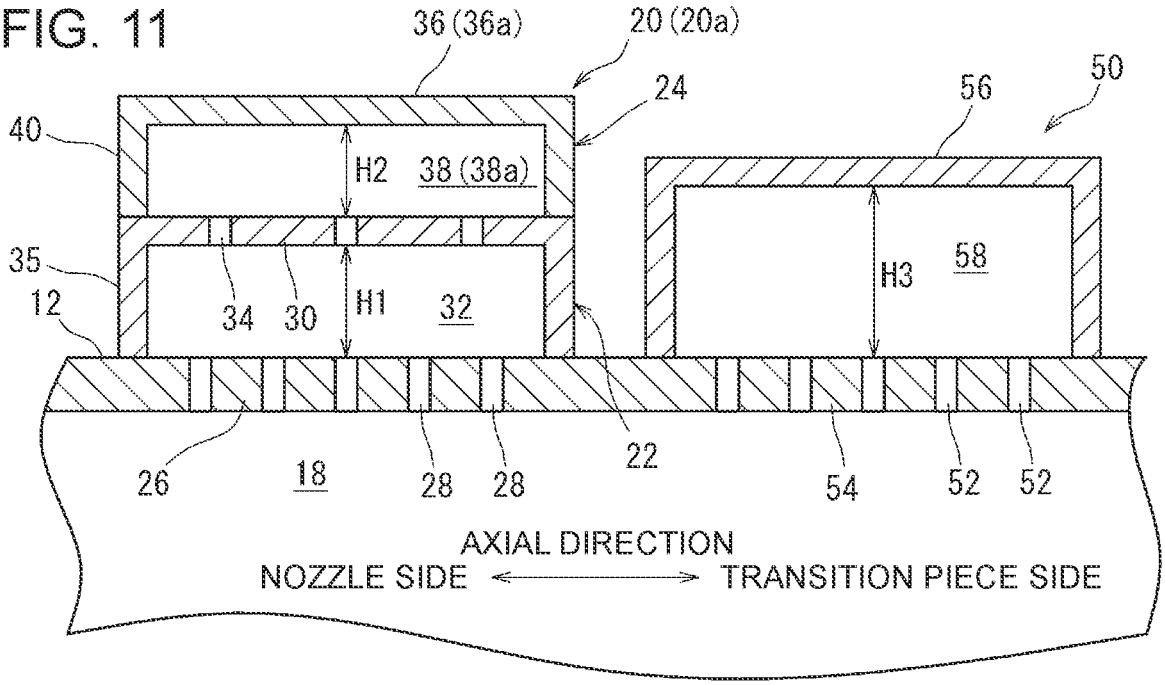
FIG. 11 is a vertical cross-sectional view corresponding to FIG. 4, schematically showing the second acoustic device according to another embodiment of the present invention along with the first acoustic device.
Figure 12:
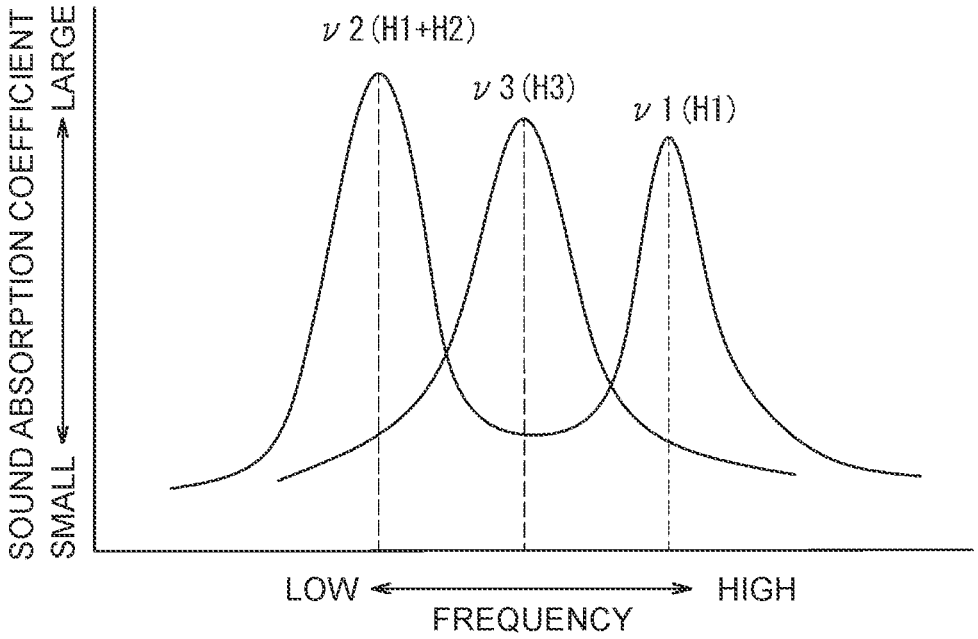
FIG. 12 is a schematic graph showing the sound absorption property of the first acoustic device and the second acoustic device shown in FIG. 11.

FIG. 11 is a vertical cross-sectional view corresponding to FIG. 4, schematically showing the second acoustic device 50 according to another embodiment of the present invention along with the first acoustic device 20*a*. FIG. 12 is a schematic graph showing the sound absorption property of the first acoustic device 20*a* and the second acoustic device 50.

Figure 13:
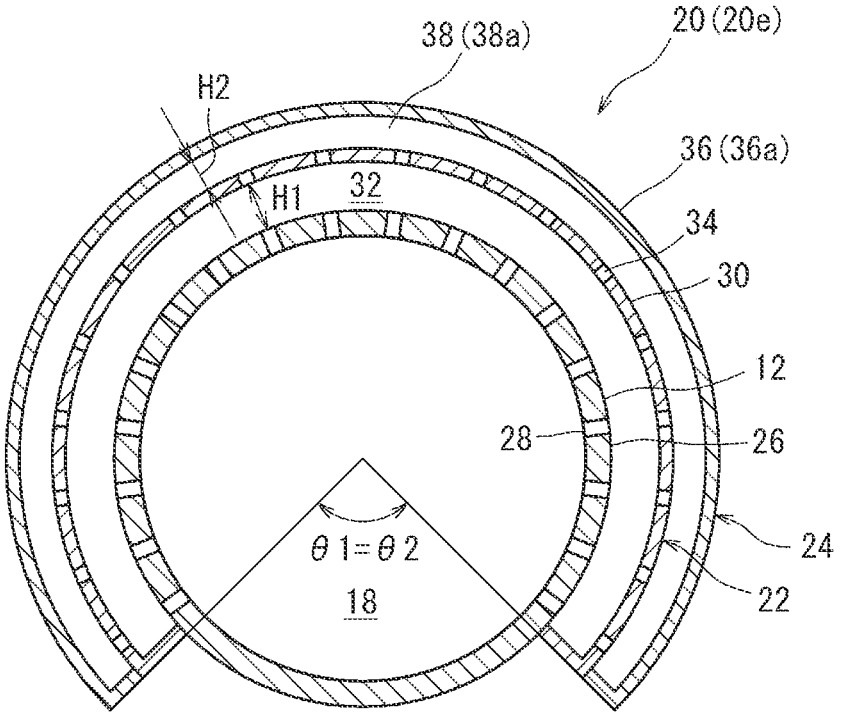
FIG. 13 is a lateral cross-sectional view corresponding to FIG. 5, schematically showing the first acoustic device according to another embodiment of the present invention.
Figure 14:
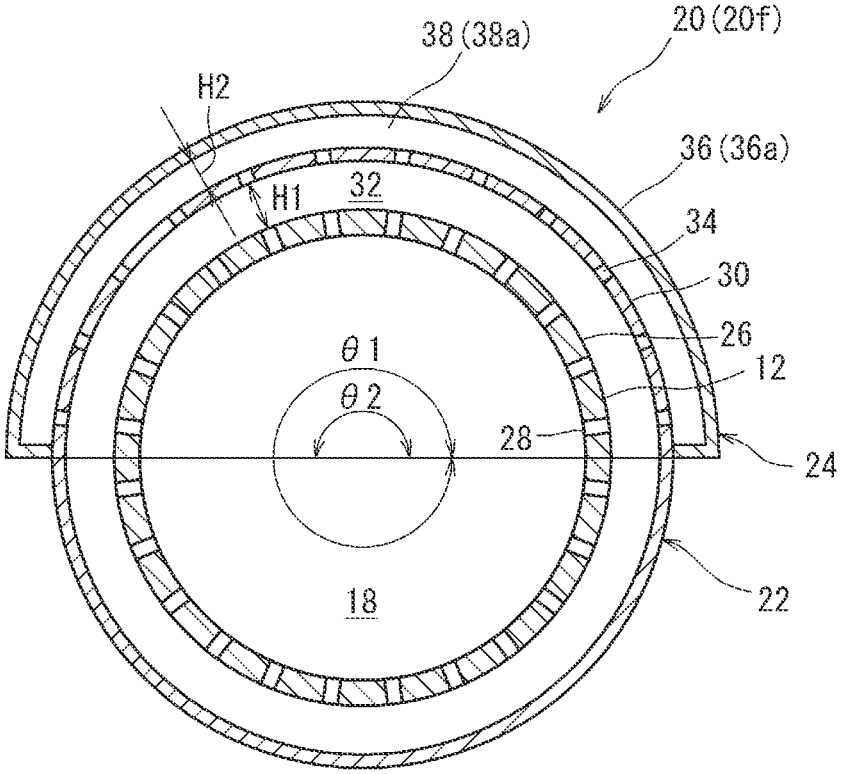
FIG. 14 is a lateral cross-sectional view corresponding to FIG. 5, schematically showing the first acoustic device according to another embodiment of the present invention.

FIGS. 13 and 14 are each a lateral cross-sectional view corresponding to FIG. 5, schematically showing the first acoustic device 20*e*, 20*f* according to another embodiment of the present invention.

As shown in FIGS. 3 to 5, 7 to 9, 11, 13, and 14, the first acoustic device 20 (20*a* to 20*f*) includes the first casing portion 22 and the second casing portion 24. The combustion liner 12 has the first region 26 covered with the first casing portion 22, and the first region 26 has at least one first opening 28 formed therein. For instance, a plurality of first openings 28 are formed in the first region 26, and each first opening 28 has a circular cross-sectional shape. For instance, the opening area of the first opening 28 is not larger than 5% of the area of the first region 26.

The first casing portion 22 has at least one first wall 30 disposed facing the first region 26, on the outer side of the combustion liner 12. At least one first space 32 is defined between the first region 26 and the first wall 30 facing each other at a distance in the radial direction in the combustion liner 12. The first space 32 is in communication with the interior space 18 through the first opening 28. The first wall 30 has at least one second opening 34 formed thereon. For instance, the first casing portion 22 has two first side walls 35 having a U-shape in a cross section orthogonal to the circumferential direction of the combustion liner 12, and connected to both sides of the first wall 30 in the axial direction of the combustion liner 12. The first casing portion 22 is fixed to the combustion liner 12 by welding, for instance.

The second casing portion 24 has at least one second wall 36 (36*a*, 36*b*, 36*c*) disposed facing the first wall 30, on the outer side of the first casing portion 22. At least one second space 38 (38*a*, 38*b*, 38*c*) is defined between the first wall 30 and the second wall 36 (36*a*, 36*b*, 36*c*) facing each other at a distance in the radial direction of the combustion liner 12. The second space 38 (38*a*, 38*b*, 38*c*) is in communication with the first space 32 through the second opening 34.

In the above gas turbine 1, at least one second space 38 (38*a*, 38*b*, 38*c*) exists on the outer side of the first space 32 and is in communication with the first space 32 through the first opening 28, and thereby the first acoustic device 20 (20*a* to 20*f*) has a plurality of tuning frequencies ν1, ν2 (ν2*a*, ν2*b*, ν2*c*), as shown in FIGS. 6, 10, and 12. Thus, it is possible to damp a plurality of combustion oscillation modes having different frequencies with the first acoustic device 20.

In some embodiments, the acoustic device 20*a*, 20*e*, 20*f* further includes a single second space 38*a*, as shown in FIGS. 4, 5, 11, 13, and 14. For instance, the second casing portion 24 has two second side walls 40 having a U-shape in a cross section orthogonal to the circumferential direction of the combustion liner 12, and connected to both sides of the second wall 36 in the axial direction of the combustion liner 12. For instance, the second casing portion 24 is fixed to the first casing portion 22 by welding, for instance.

The first acoustic device 20*a* has a sound absorption property as shown in FIG. 6, and the first acoustic device 20*a* has two tuning frequencies ν1,ν2 at which the sound absorption coefficient increases. Thus, it is possible to damp a plurality of combustion oscillation modes having different frequencies with the first acoustic device 20.

In the first acoustic device 20*a*, from among the two tuning frequencies ν1, ν2 in FIG. 6, the lower tuning frequency ν2 is determined by the sum (H1+H2) of the height H1 of the first space 32 and the height H2 of the second space 38, and the higher tuning frequency ν1 is determined by the height H1 of the first space 32.

In some embodiments, the height H1 of the first space 32 is equal to the height H2 of the second space 38 (H1=H2).

In some embodiments, the height H1 of the first space 32 is greater than the height H2 of the second space 38 (H1>H2).

In some embodiments, the height H1 of the first space 32 is smaller than the height H2 of the second space 38 (H1<H2).

In some embodiments, as shown in FIGS. 7 to 9, the at least one second space 38 includes a plurality of second spaces 38 (38*a*, 38*b*, 38*c*). The plurality of second spaces 38 (38*a*, 38*b*, 38*c*) are separated from one another by partition walls 42, and have different heights H2*a*, H2*b*, H2*c* in the radial direction of the combustion liner 12.

In the above gas turbine 1, the plurality of second spaces 38 (38*a*, 38*b*, 38*c*) separated by the partition walls 42 have different heights H2*a*, H2*b*, H2*c*, and thereby the first acoustic device 20*b*, 20*c*, 20*d* can have more tuning frequencies ν1, ν2 (ν2*a*, ν2*b*, ν2*c*). Thus, it is possible to damp more combustion oscillation modes with the first acoustic device 20*b*, 20*c*, 20*d*.

In FIGS. 7 to 9, the second space 38 has three heights H2*a* to H2*c*, but the set value of the height H2 may be two, or four or more.

Furthermore, the partition wall 42 may be formed integrally with the second wall 36 (36*a*, 36*b*, 36*c*), or may be joined to the second wall 36 (36*a*, 36*b*, 36*c*) by welding or the like. In other words, the second casing portion 24 may be formed integrally, or may be formed of a plurality of members.

Furthermore, even in a case in which the second space 38 has a constant height H2 as shown in FIGS. 3 to 5, 13 and 14, the partition wall 42 may be provided inside the second casing 24 to define the plurality of second spaces 38.

In some embodiments, as shown in FIG. 7, the plurality of second spaces 38 (38*a*, 38*b*, 38*c*) are arranged along the circumferential direction of the combustion liner 12. In this case, the partition walls 42 extend along the axial direction of the combustion liner 12.

In the above gas turbine 1, the plurality of second spaces 38 (38*a*, 38*b*, 38*c*) are arranged along the circumferential direction of the combustion liner 12, and thus it is possible to provide the plurality of second spaces 38 (38*a*, 38*b*, 38*c*) having different heights H2 (H2*a*, H2*b*, H2*c*) with a simple configuration.

In some embodiments, as shown in FIGS. 8 and 9, the plurality of second spaces 38 (38*a*, 38*b*, 38*c*) are arranged along the axial direction of the combustion liner 12. In this case, the partition walls 42 extend along the circumferential direction of the combustion liner 12.

In the above gas turbine 1, the plurality of second spaces 38 (38*a*, 38*b*, 38*c*) are arranged along the axial direction of the combustion liner 12, and thus it is possible to provide the plurality of second spaces 38 (38*a*, 38*b*, 38*c*) having different heights H2 (H2*a*, H2*b*, H2*c*) with a simple configuration.

In some embodiments, as shown in FIG. 9, the heights H2 (H2*a*, H2*b*, H2*c*) of the plurality of second spaces 38 (38*a*, 38*b*, 38*c*) decrease in stages toward the nozzle 16 in the axial direction of the combustion liner 12.

In the vicinity of flame, that is, in the vicinity of the nozzle 16, a combustion oscillation mode with a higher frequency tends to occur, compared to in a region farther from the flame. Corresponding to this tendency, in the above gas turbine 1, the heights H2 (H2*a*, H2*b*, H2*c*) of the second spaces 38 decrease in stages toward the nozzle 16 in the axial direction of the combustion liner 12, and thereby it is possible to damp the combustion oscillation mode of a high frequency in the vicinity of the flame.

In some embodiments, as shown in FIG. 3, the first acoustic device 20 (20*a* to 20*f*) is disposed within a range corresponding to the inner diameter of the combustion liner 12 from the tip of the nozzle 16, with respect to the axial direction of the combustion liner 12. Within the range corresponding to the inner diameter of the combustion liner 12 from the tip of the nozzle 16, a larger number of combustion oscillation modes tends to occur than outside the range. Corresponding to this tendency, with the above gas turbine 1, the first acoustic device 20 (20*a* to 20*f*) is disposed within the range corresponding to the inner diameter of the combustion liner 12 in the axial direction of the combustion liner 12, and thereby it is possible to damp a large number of combustion oscillation modes effectively.

In some embodiments, as shown in FIG. 11, the gas turbine 1 further includes the second acoustic device 50 mounted to the combustor 3, in addition to the first acoustic device 20 (20*a* to 20*f*).

In this case, the combustion liner 12 further includes the second region 54 having at least one third opening 52 formed thereon. The second acoustic device 50 has the third wall 56 disposed facing the second region 54 on the outer side of the combustion liner 12, and defines, between the second region 54 and the third wall 56, at least one third space 58 that is in communication with the inside of the combustion liner 12 through the at least one third opening 52.

As shown in FIG. 12, the second acoustic device 50 has a tuning frequency ν3 corresponding to the height H3 of the third space 58. Thus, in the above gas turbine 1, it is possible to damp even more combustion oscillation modes by providing the second acoustic device 50 in addition to the first acoustic device 20 (20*a* to 20*f*).

In some embodiments, as shown in FIG. 11, the sum (H1+H2) of the height H1 of the first space 32 and the height H2 of the second space 38 in the radial direction of the combustion liner 12 is greater than the height H3 of the third space 58, while the height H1 of the first space 32 is smaller than the height H3 of the third space.

In the gas turbine 1 of the above configuration, the tuning frequency ν3 of the second acoustic device 50 is positioned between the two frequencies ν1, ν2 of the first acoustic device 20*a*. Thus, it is possible to damp combustion oscillation modes continuously over a wide frequency range.

In some embodiments, the sum (H1+H2) of the height H1 of the first space 32 and the height H2 of the second space 38 of the first acoustic device 20 in the radial direction of the combustion liner 12 is equal to the height H3 of the third space 48 of the second acoustic device 50. In this configuration, the tuning frequencies ν2 and ν3 are equal, and thereby it is possible to improve the sound absorption coefficient in the vicinity of the tuning frequencies ν2, ν3.

In some embodiments, the sum (H1+H2) of the height H1 of the first space 32 and the height H2 of the second space 38 of the first acoustic device 20 in the radial direction of the combustion liner 12 is smaller than the height H3 of the third space 58 of the second acoustic device 50. In this configuration, the tuning frequency ν3 is lower than the tuning frequency ν2, and it is possible to suppress the combustion oscillation mode of a relatively high frequency with the first acoustic device 20 while suppressing the combustion oscillation mode of a relatively low frequency with the second acoustic device 50.

In some embodiments, as shown in FIG. 11, the first acoustic device 20 (20*a* to 20*f*) is disposed closer to the nozzle 16 than the second acoustic device 50 in the axial direction of the combustion liner 12.

The closer to the nozzle 16, a larger number of combustion oscillation modes tends to occur. Corresponding to this tendency, with the above gas turbine 1, the first acoustic device 20 is disposed closer to the nozzle 16 than the second acoustic device 50 in the axial direction of the combustion liner 12, and thereby it is possible to damp a large number of combustion oscillation modes effectively.

In some embodiments, as shown in FIG. 13, the first wall 30 and the second wall 36 do not extend over the entire circumference in the circumferential direction of the combustion liner 12, but covers the combustion liner 12 partially.

In some embodiments, as shown in FIG. 14, the first wall 30 extends over the entire circumference in the circumferential direction of the combustion liner 12, while the second wall covers the first wall 30 partially.

In some embodiments, as shown in FIGS. 5, 7, and 13, the central angle θ1 representing the existence range of the first wall 30 about the axis of the combustion liner 12 is the same as the central angle θ2 representing the existence range of the second wall 36 (θ1=θ2).

In some embodiments, as shown in FIG. 14, the central angle θ1 representing the existence range of the first wall 30 about the axis of the combustion liner 12 is greater than the central angle θ2 representing the existence range of the second wall 36 (θ1>θ2).

Figure 15:
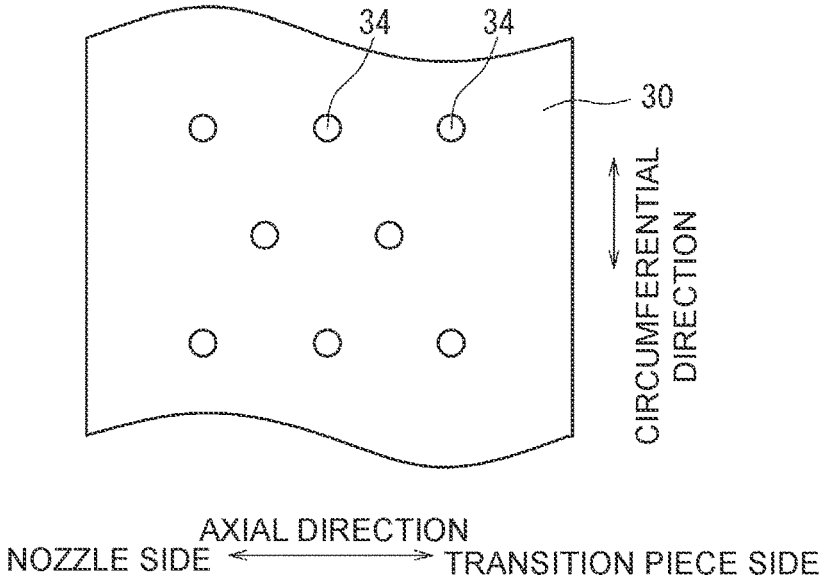
FIG. 15 is a diagram for describing an example of the shape and the layout of the second opening that can be applied to the first acoustic device.
Figure 16:
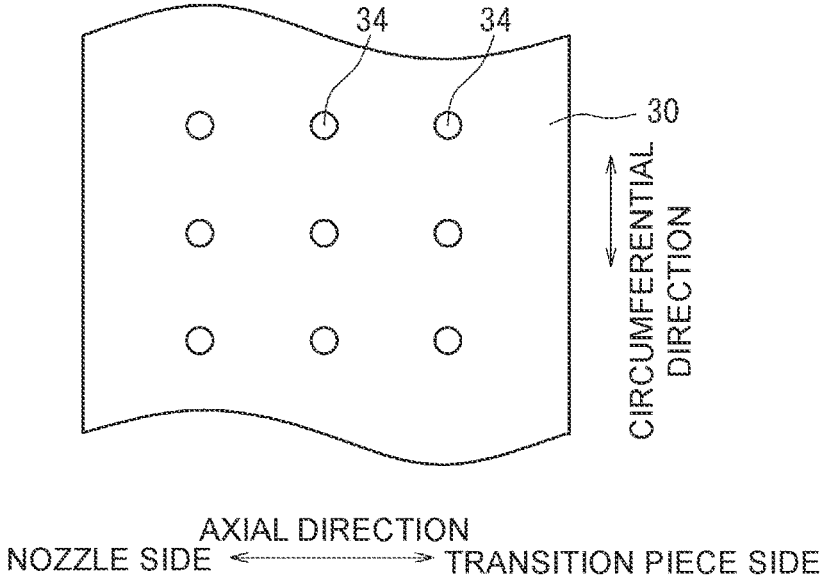
FIG. 16 is a diagram for describing an example of the shape and the layout of the second opening that can be applied to the first acoustic device.
Figure 17:
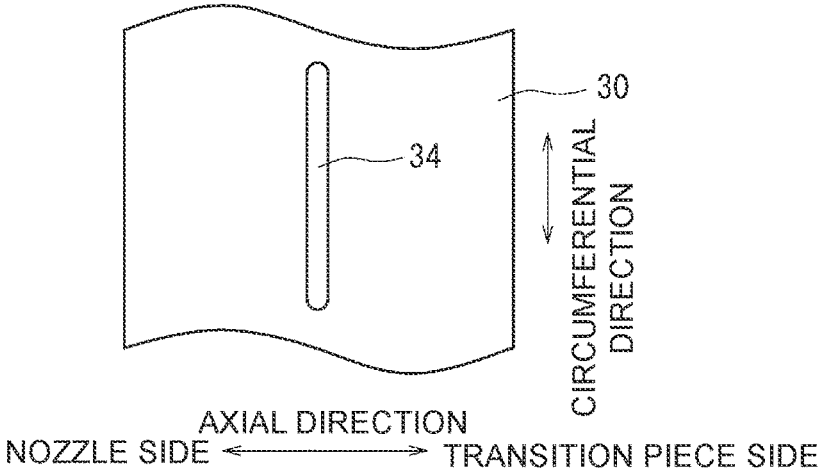
FIG. 17 is a diagram for describing an example of the shape and the layout of the second opening that can be applied to the first acoustic device.
Figure 18:
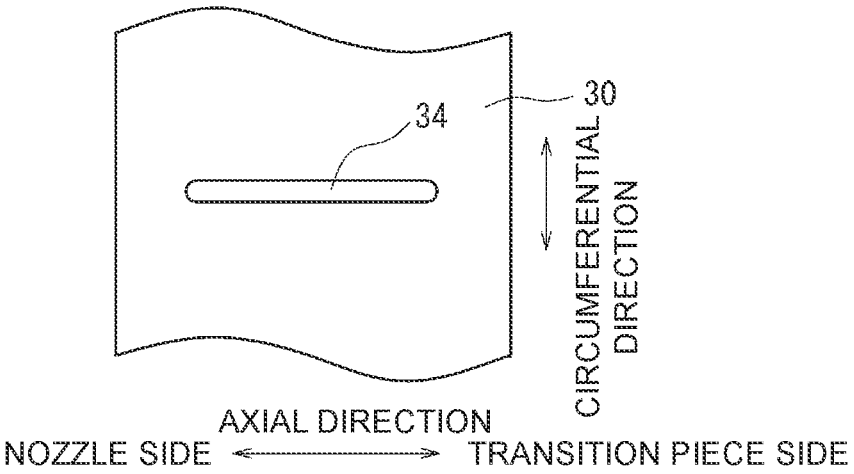
FIG. 18 is a diagram for describing an example of the shape and the layout of the second opening that can be applied to the first acoustic device.
Figure 19:
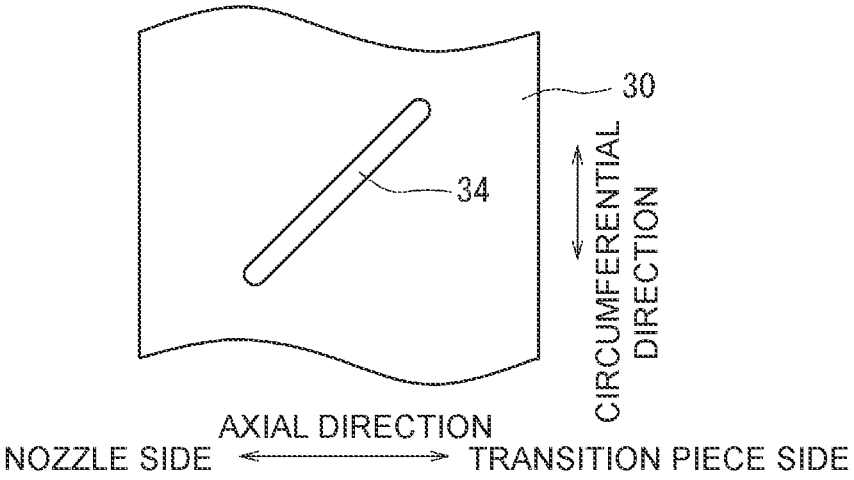
FIG. 19 is a diagram for describing an example of the shape and the layout of the second opening that can be applied to the first acoustic device.

In some embodiments, the second opening 34 formed on the first wall 30 has a circular shape as shown in FIGS. 15 and 16, or a slit shape or a long hole shape as shown in FIGS. 17 to 19. The shape of the second opening 34 formed on the first wall 30 is not limited to the above, and may be an oval shape, or a combination of more than one shape.

In some embodiments, the ratio (opening ratio) of the total area of the second openings 34 to the area of the first wall 30 is set to be not greater than 5%.

In some embodiments, the diameter or the width of the second opening 34 is set to be smaller than the height H2 of the second space 38.

FIGS. 15 to 19 are each a diagram for describing an example of the shape and the layout of the second opening 34 that can be applied to the first acoustic device 20 (20*a* to 20*f*). FIGS. 15 to 19 are each a schematic view of a part of the first wall 30 developed on a plane.

In some embodiments, the second openings 34 are arranged in a staggered (zig-zag) pattern as shown in FIG. 15, or in a grid pattern as shown in FIG. 16.

In some embodiments, the second opening 34 extends in the circumferential direction of the combustion liner 12 as shown in FIG. 17, in the circumferential direction of the combustion liner 12 as shown in FIG. 18, or obliquely with respect to the circumferential direction and the axial direction of the combustion liner 12 as shown in FIG. 19.

The layout of the second openings 34 formed on the first wall 30 is not limited to the examples shown in FIGS. 15 to 19.

In some embodiments, a purge hole having an opening on the outer surface of the first acoustic device 20 may be formed on the first casing portion 22 or the second casing portion 24, for cooling the first space 32 or the second space 38. In this case, the purge hole brings the first space 32 or the second space 38 and the outside of the first acoustic device 20 into communication, so that compressed air flowing around the first acoustic device 20 flows into the first space 32 or the second space 38 during operation of the gas turbine 1. During operation of the gas turbine 1, the pressure around the first acoustic device 20 is higher than the pressure inside the combustion liner 12, and thus combustion gas does not flow out from the interior space 18 through the first opening 28.

In some embodiments, the first wall 30 and the second wall 36 extend along the axial direction and the circumferential direction of the combustion liner 12 so that the height H1 of the first space 32 is constant in the axial direction and the circumferential direction of the combustion liner 12, and the height H2 (H2*a*, H2*b*, H2*c*) of each second space 38 is constant in the axial direction and the circumferential direction of the combustion liner 12.

In some embodiments, the second space 38 has a rectangular shape in a cross section orthogonal to the circumferential direction of the combustion liner 12, and an annular or sector shape in a cross section orthogonal to the axial direction of the combustion liner 12.

In some embodiments, the first openings 28 and the second openings 34 are in different or same positions in the axial direction of the combustion liner 12.

Embodiments of the present invention were described in detail above, but the present invention is not limited thereto, and various amendments and modifications may be implemented.

DESCRIPTION OF REFERENCE NUMERALS

1 Gas turbine
2 Compressor
3 Combustor
4 Turbine
6 Generator (exterior device)
7 Housing
8 Combustor installation space
10 Nozzle portion
12 Combustion liner
14 Transition piece
16 Nozzle
16*a* Pilot nozzle
16*b* Main nozzle
18 Interior space
20 (20*a* to 20*f*) First acoustic device
22 First casing portion
24 Second casing portion
26 First region
28 First opening
30 First wall
32 First space
34 Second opening
35 First side wall
36 (38*a* to 38*c*) Second wall
38 (38*a* to 38*c*) Second space
40 Second side wall
42 Partition wall
50 Second acoustic device
52 Third opening
54 Second region
56 Third wall
58 Third space

The invention claimed is:

1. A combustor, comprising:

a combustion liner having a first region in which at least one first opening is formed;

a nozzle configured to inject a fuel into the combustion liner; and a first acoustic device mounted to the combustion liner, wherein the first acoustic device includes:

a first casing portion having at least one first wall which is disposed facing the first region on an outer side of the combustion liner and which has at least one second opening formed thereon, the first casing portion defining, between the first region and the at least one first wall, at least one first space being in communication with an inside of the combustion liner through the at least one first opening; and a second casing portion having at least one second wall which is disposed facing the at least one first wall on an outer side of the first casing portion, the second casing portion defining, between the at least one first wall and the at least one second wall, at least one second space being in communication with the at least one first space through the at least one second opening, wherein the at least one second space includes a plurality of second spaces separated from one another by a partition wall and having different heights in a radial direction of the combustion liner, wherein the plurality of second spaces are arranged along an axial direction of the combustion liner, and wherein the heights of the plurality of second spaces decrease in stages toward the nozzle in the axial direction of the combustion liner.

2. The combustor according to claim 1, wherein the first acoustic device is disposed within a range corresponding to an inner diameter of the combustion liner from a tip of the nozzle, in an axial direction of the combustion liner.

3. The combustor according to claim 1, further comprising a second acoustic device mounted to the combustor, wherein the combustion liner further includes a second region in which at least one third opening is formed, and wherein the second acoustic device includes a third wall disposed facing the second region on an outer side of the combustion liner, the second acoustic device defining, between the second region and the third wall, at least one third space being in communication with the inside of the combustion liner through the at least one third opening.

4. The combustor according to claim 3, wherein a sum of a height of the first space and a height of the second space in a radial direction of the combustion liner is greater than a height of the third space, and the height of the first space is smaller than the height of the third space.

5. The combustor according to claim 3, wherein the first acoustic device is disposed closer to the nozzle than the second acoustic device in the axial direction of the combustion liner.

6. A gas turbine, comprising:

the combustor according to claim 1; and a turbine configured to generate a rotational force from combustion gas produced through combustion of the fuel by the combustor.

7. A combustor, comprising:

a combustion liner having a first region in which at least one first opening is formed;

a nozzle configured to inject a fuel into the combustion liner;

a first acoustic device mounted to the combustion liner, and a second acoustic device mounted to the combustor, wherein the first acoustic device includes:

a first casing portion having at least one first wall which is disposed facing the first region on an outer side of the combustion liner and which has at least one second opening formed thereon, the first casing portion defining, between the first region and the at least one first wall, at least one first space being in communication with an inside of the combustion liner through the at least one first opening; and a second casing portion having at least one second wall which is disposed facing the at least one first wall on an outer side of the first casing portion, the second casing portion defining, between the at least one first wall and the at least one second wall, at least one second space being in communication with the at least one first space through the at least one second opening, wherein the at least one second space includes a plurality of second spaces separated from one another by a partition wall and having different heights in a radial direction of the combustion liner, wherein the combustion liner further includes a second region in which at least one third opening is formed, wherein the second acoustic device includes a third wall disposed facing the second region on an outer side of the combustion liner, the second acoustic device defining, between the second region and the third wall, at least one third space being in communication with the inside of the combustion liner through the at least one third opening, and wherein a sum of a height of the first space and a height of the second space in a radial direction of the combustion liner is greater than a height of the third space, and the height of the first space is smaller than the height of the third space.

8. The combustor according to claim 7, wherein the plurality of second spaces are arranged along a circumferential direction of the combustion liner.

9. The combustor according to claim 7, wherein the plurality of second spaces are arranged along an axial direction of the combustion liner.

10. The combustor according to claim 7, wherein the first acoustic device is disposed within a range corresponding to an inner diameter of the combustion liner from a tip of the nozzle, in an axial direction of the combustion liner.

11. The combustor according to claim 7, wherein the first acoustic device is disposed closer to the nozzle than the second acoustic device in the axial direction of the combustion liner.

12. A gas turbine, comprising:

the combustor according to claim 7; and a turbine configured to generate a rotational force from combustion gas produced through combustion of the fuel by the combustor.

* * * * *